US012434089B1

(12) United States Patent
Nolan et al.

(10) Patent No.: US 12,434,089 B1
(45) Date of Patent: Oct. 7, 2025

(54) BELT AND PENDULUM SQUAT ATTACHMENT FOR USE WITH AN EXERCISE RIG

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 200 days.

(21) Appl. No.: 18/477,019

(22) Filed: Sep. 28, 2023

Related U.S. Application Data

(60) Provisional application No. 63/513,402, filed on Jul. 13, 2023, provisional application No. 63/411,288, filed on Sep. 29, 2022.

(51) Int. Cl.
*A63B 21/06* (2006.01)
*A63B 21/00* (2006.01)

(52) U.S. Cl.
CPC ..... *A63B 21/0615* (2013.01); *A63B 21/4035* (2015.10); *A63B 2225/093* (2013.01)

(58) Field of Classification Search
CPC ..... A63B 21/4035; A63B 21/0615; A63B 21/0616
See application file for complete search history.

(56) References Cited

U.S. PATENT DOCUMENTS

| | | | | |
|---|---|---|---|---|
| 6,387,023 | B1 * | 5/2002 | Liga, Jr. | A63B 21/4049 482/121 |
| D898,137 | S * | 10/2020 | Carmichael | D21/688 |
| D931,953 | S * | 9/2021 | Kuka | D21/686 |
| 2007/0054785 | A1 * | 3/2007 | Drechsler | A63B 21/156 482/94 |
| 2007/0161472 | A1 * | 7/2007 | Drechsler | A63B 21/4045 482/99 |
| 2023/0099317 | A1 * | 3/2023 | Tighe | A47B 57/485 211/85.7 |
| 2023/0338768 | A1 * | 10/2023 | Sorin | A63B 21/00072 |
| 2024/0342538 | A1 * | 10/2024 | Crandall | A63B 21/08 |
| 2025/0128117 | A1 * | 4/2025 | Jones | A63B 21/4035 |

FOREIGN PATENT DOCUMENTS

| | | | | |
|---|---|---|---|---|
| CN | 109069898 | A * | 12/2018 | A63B 21/4035 |
| DE | 102023001065 | A1 * | 9/2024 | A63B 21/08 |

* cited by examiner

*Primary Examiner* — Joshua T Kennedy
(74) *Attorney, Agent, or Firm* — AVEK IP, LLC

(57) ABSTRACT

A belt and pendulum squat attachment for an exercise rig includes a plate configured to secure to a vertical post; an arm extending from a first end to a second end, the first end coupled to the plate via a hinge connection; a first stationary side arm and a second stationary side arm each extending from the plate such that the arm is positioned substantially between the first stationary side arm and the second stationary side arm; and a rotating hook and latch system coupled to the first stationary side arm and the second stationary side arm, the rotating hook and latch system supporting the arm; the arm is to pivot about the hinge connection via operation by a user.

8 Claims, 5 Drawing Sheets

BELT AND PENDULUM SQUAT ATTACHMENT FOR USE WITH AN EXERCISE RIG

RELATED APPLICATIONS

This application claims priority to U.S. Provisional Application No. 63/411,288, filed Sep. 29, 2022, and U.S. Provisional Application No. 63/513,402, filed Jul. 13, 2023. Both of the foregoing are incorporated by reference in their entireties herein.

FIELD OF INVENTION

The present invention relates generally to exercise machines, and more specifically to a belt and pendulum squat attachment that can be mounted to an exercise rig, thereby allowing for the user to perform belt and pendulum squat variations.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure is a belt and pendulum squat attachment for an exercise rig, the belt and pendulum squat attachment comprising a plate configured to secure to a vertical post; an arm extending from a first end to a second end, the first end coupled to the plate via a hinge connection; a first stationary side arm and a second stationary side arm each extending from the plate such that the arm is positioned substantially between the first stationary side arm and the second stationary side arm; and a rotating hook and latch system coupled to the first stationary side arm and the second stationary side arm, the rotating hook and latch system supporting the arm; wherein the arm is configured to pivot about the hinge connection via operation by a user.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise machines are well known in the art and are effective means to provide various functions for the user to engage in one or more exercises. It is common for exercise machines to be designed for one type of exercise. In particular, belt squat machines facilitate squats by increasing leg and hip strength without adding load and pressure to the user's back. Similarly, pendulum squat machines facilitate squats in an arcing-type motion to remove load and presser from the user's back. One of the problems associated with such exercise machines is their limited use. For example, users are unable to perform both belt squats and pendulum squats on a single machine. The user must move on to another machine designed specifically for belt squats or pendulum squats. Accordingly, it is an object of the present invention to provide a belt and pendulum squat attachment that addresses the limitations discussed above.

The system and method of use in accordance with the present application overcomes one or more of the above-discussed problems commonly associated with conventional exercise machines. Specifically, the present invention provides for a belt and pendulum squat attachment that can be mounted to an exercise rig and can be used to perform both belt and pendulum squat exercise variations on the same exercise rig. In addition, the present invention provides for a belt and pendulum squat attachment that can be attached to a variety of vertical posts, thereby allowing for a user to add the attachment to diverse equipment depending on their needs. These and other unique features of the system and method of use are discussed below and illustrated in the accompanying drawings.

Figure 1:
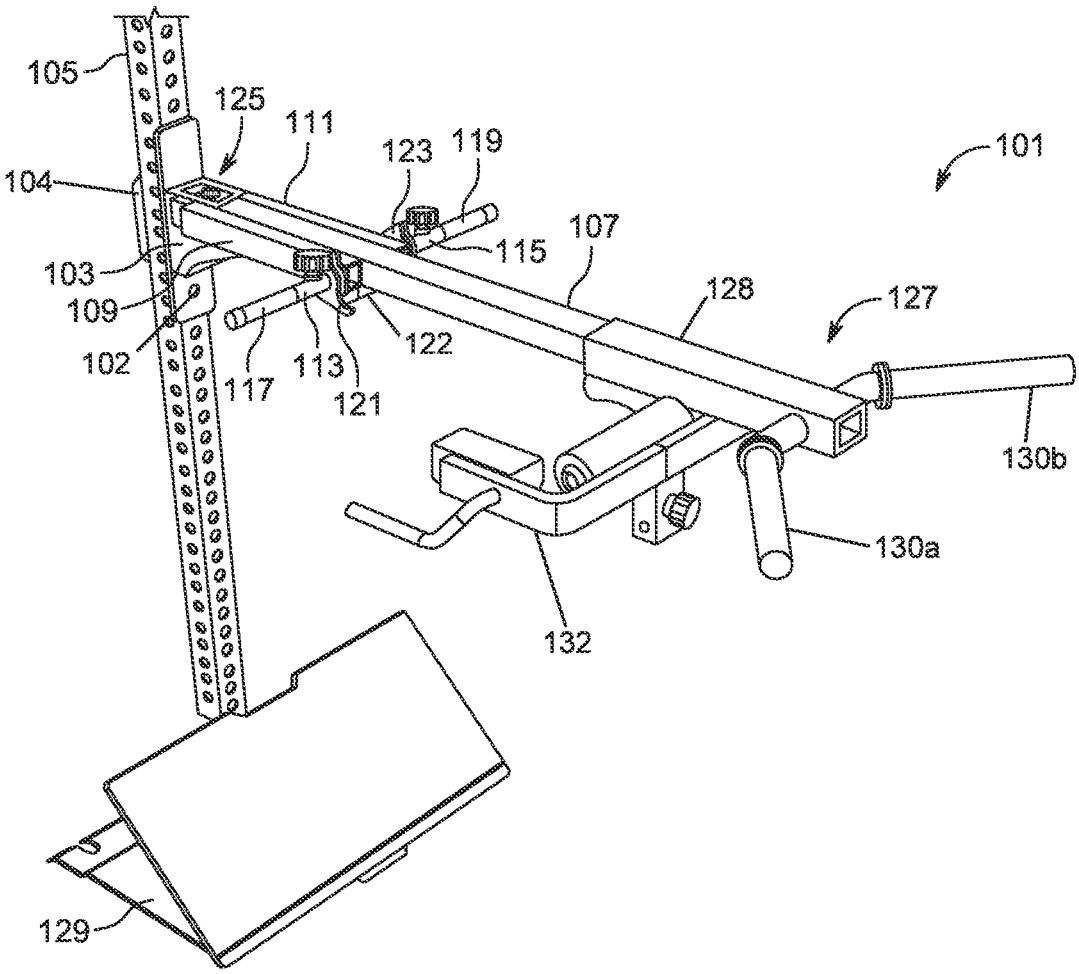
FIG. 1 is a front left perspective view of a belt and pendulum squat attachment in a first configuration and in accordance with the present application.
Figure 2:
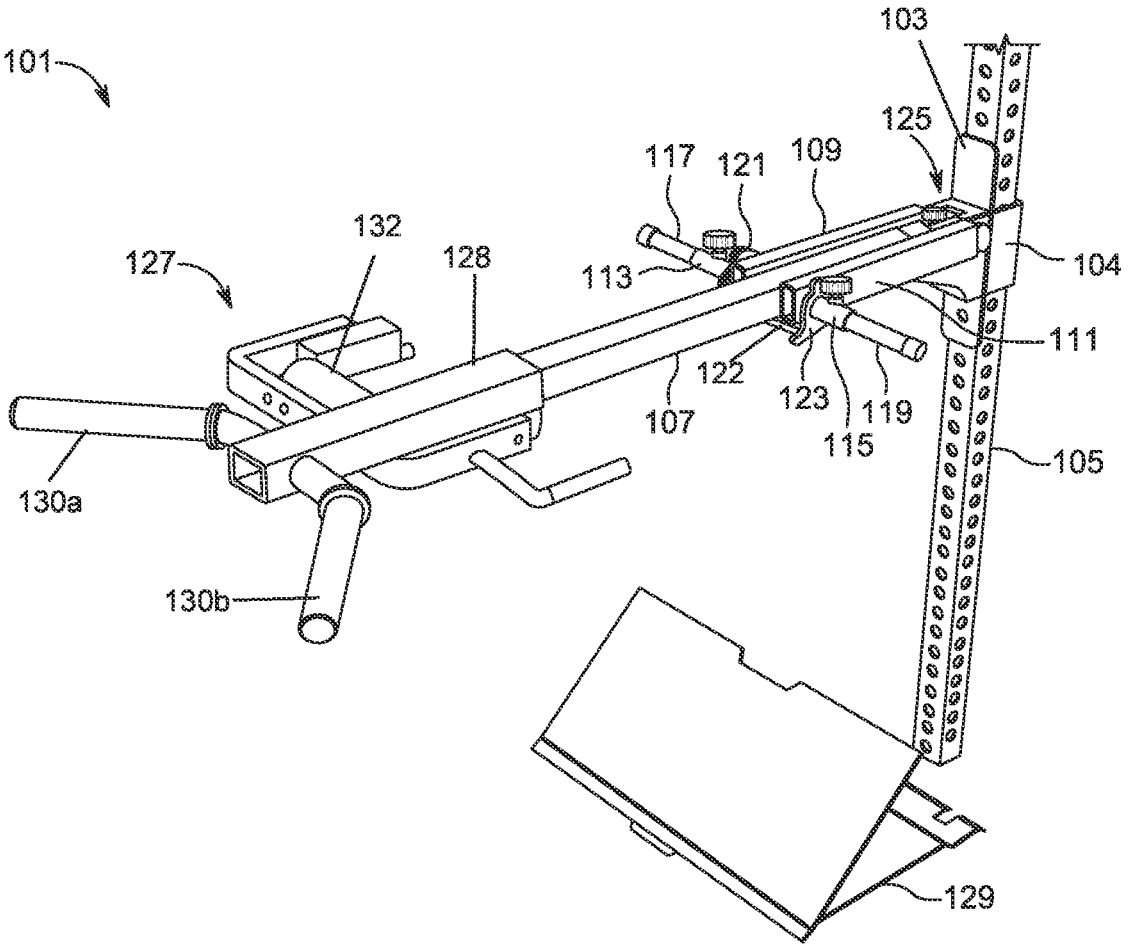
FIG. 2 is a front right perspective view of the attachment of FIG. 1 in the first configuration.

FIGS. 1 and 2 show a belt and pendulum squat attachment 101 in accordance with the present application. The attachment 101 includes a mounting plate 103 which attaches to a vertical post 105 at a desired position. It should be appreciated that the vertical post 105 may be, at least in part, from a Smith machine, an exercise or fitness training rig, or the like. The mounting plate 103 can vary, including one or more apertures 102 and/or being a part of a carriage 104 for wrapping at least partially around the vertical post 105 and securing at a desired height via one or more pins (not shown). Those skilled in the art will appreciate that the height can be adjusted and then the carriage 104 secured in place. Accordingly, the plate 103, aperture(s) 102, and carriage 104 provide for a means to secure the attachment 101 to the post 105 as shown at a height that depends on the use of the attachment 101, as well as the height of the user.

The attachment 101 also includes a movable arm 107 extending from the mounting plate 103 and is supported by opposing stationary side arms 109, 111. The opposing stationary side arms 109, 111 include ports 113, 115, respectively, for handle attachments 117, 119, or alternative user engageable attachments, to removably attached thereto, respectively. The user engageable attachments, such as the handle attachments 117, 119, can lock in place via pins or other locking devices. Accordingly, said user engageable attachments can be interchanged depending on the exercise to be performed and the preferences of the user.

The attachment 101 further includes a first rotating hook and latch system 121 and a second rotating hook and latch system 123. The rotating hook and latch systems 121, 123 engage with the stationary side arms 109, 111, respectively and are configured to rotate thereabout. In other words, the connection between the rotating hook and latch systems 121, 123 and their associated stationary side arms 109, 111 allows for the hook and latch systems 121, 123 to rotate thereabout, as well as the handle attachments, 117, 119, respectively. The rotating hook and latch systems 121, 123 are configured to support the arm 107 in a fixed position between side arms 109, 111. As shown, the rotating hook and latch systems 121, 123 include a connection bar 122 extending therebetween and underneath the arm 107, the connection bar 122 supporting the arm 107 as shown. When the arm 107 is in an unlocked position, the arm 107 can move in an arcing-type motion via a hinge connection 125. The hinge connection 125, in embodiments, connects the arm 107 to the plate 103 and accordingly, the arm 107 can pivot thereabout and between the stationary side arms 109, 111. This allows for a user to apply force or pressure to an underneath side of the arm 107 to engage the arm 107 in an exercise movement. Alternatively, in embodiments, the user can apply a pulling or lifting force above the arm 107 for alternative exercises.

Various other accessories may be attached to the attachment 101 to enable various exercises. For example, as seen in FIGS. 1 and 2, a shoulder pad attachment 127 may be detachably attached to the free end of the arm 107 opposite the hinge connection 125 in order to enable performance of pendulum squat exercises using the attachment 101. A foot plate 129 may be connected to the bottom of the vertical post 105 or in another suitable location to allow the user to perform pendulum squat exercises at various angles. In other examples, a back-support pad attachment (not shown) attached to the arm 107 to facilitate alternative variations of pendulum squat exercises using the attachment 101.

The shoulder pad attachment 127, in embodiments, includes a sleeve 128 for releasably engaging with the arm 107, opposing handles 130*a-b* extending outwardly, and a pad system 132. During operation, the user will utilize the pad system 132 and apply an upward force, such as with assistance from the foot plate 129.

Figure 3:
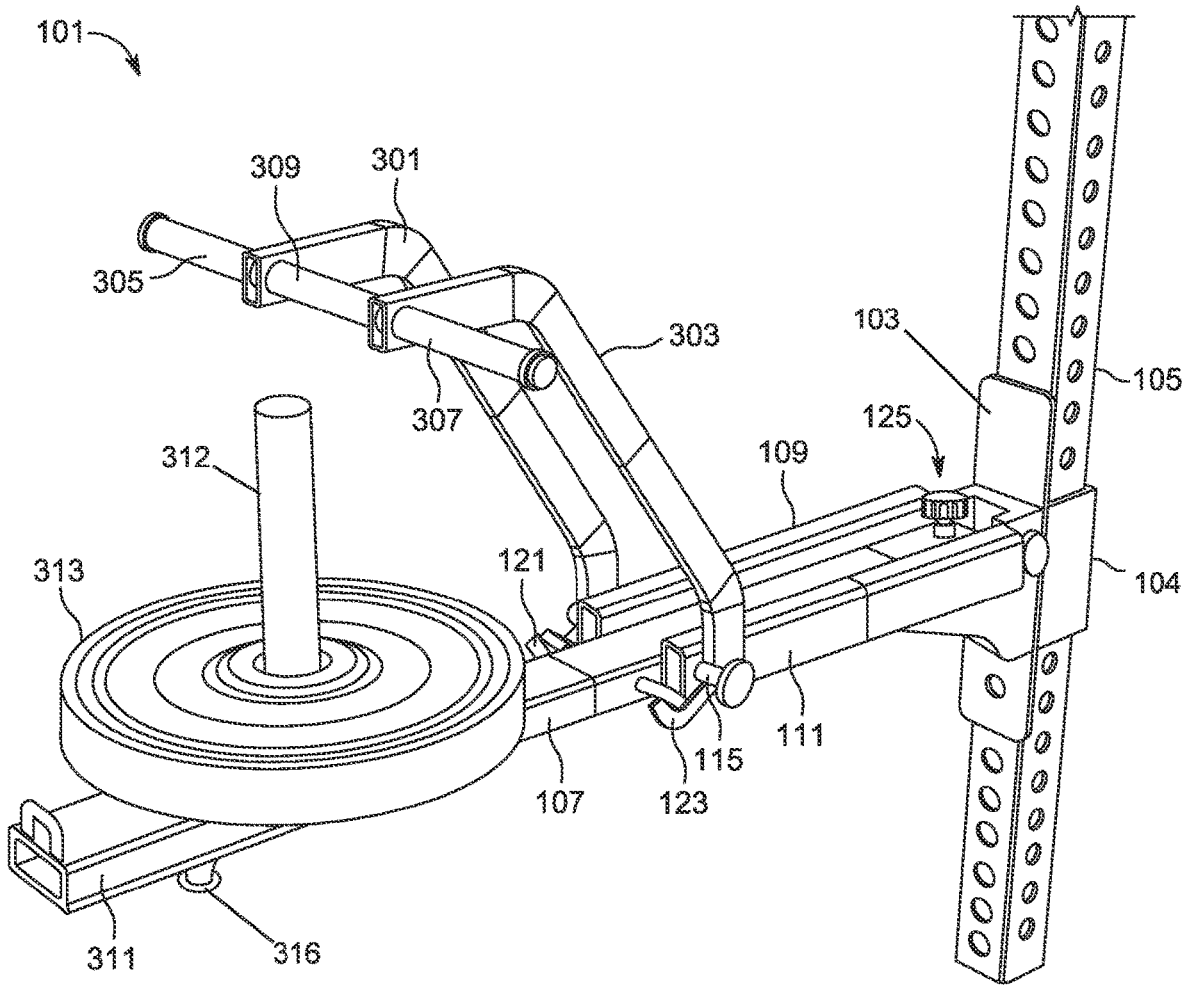
FIG. 3 is a front left perspective view of the attachment of FIG. 1 in a second configuration.
Figure 4:
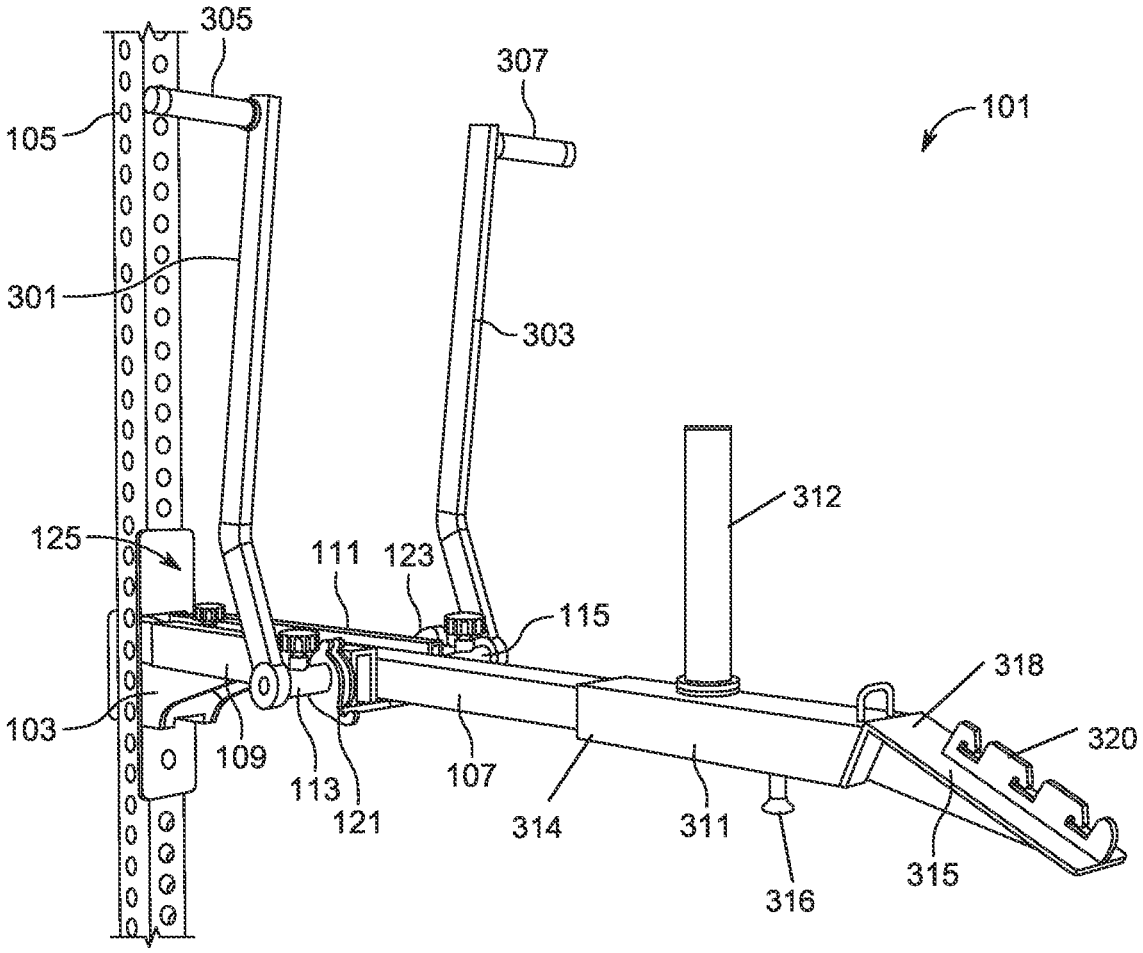
FIG. 4 is a front right perspective view of the attachment of FIG. 1 in a third configuration.
Figure 5:
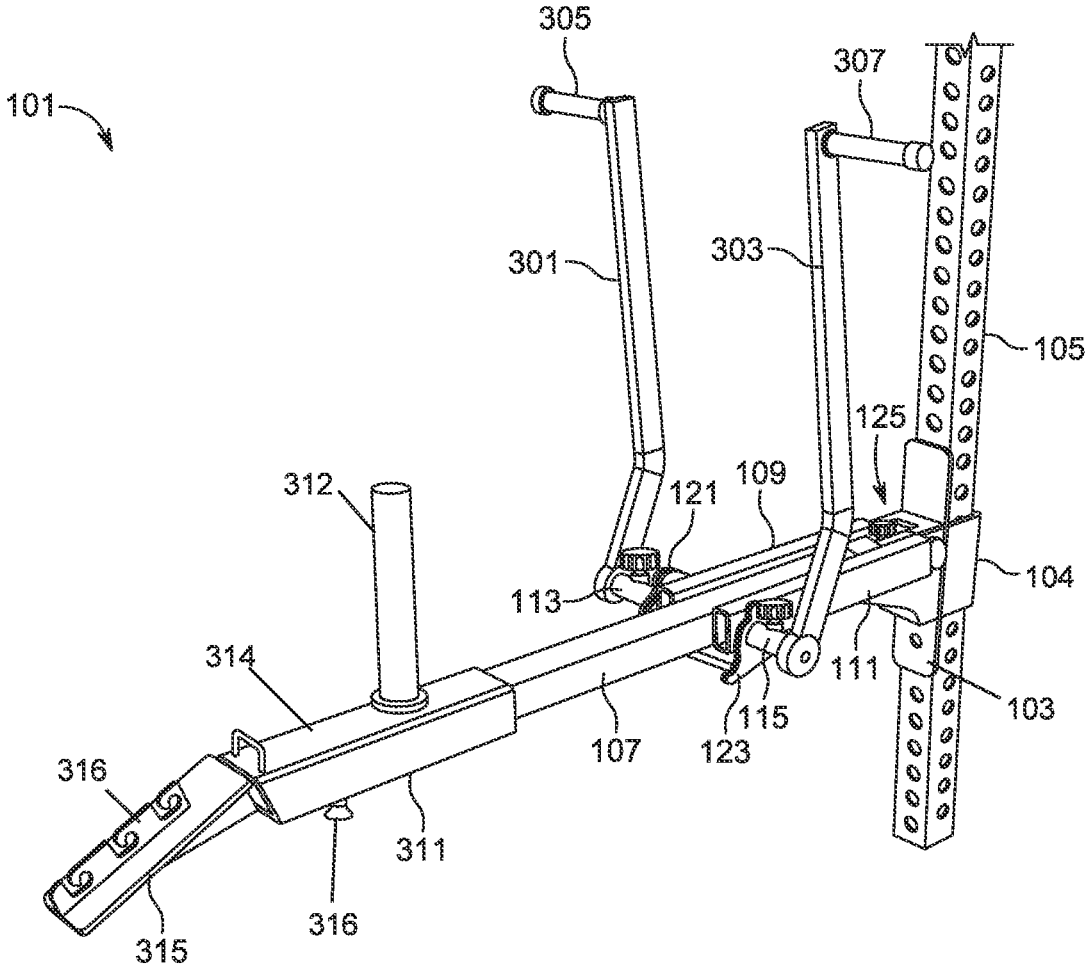
FIG. 5 is a front right perspective view of the attachment of FIG. 1 in the third configuration.

Referring now to FIGS. 3 through 5, several views of the attachment 101 are depicted in various configurations.

As shown in FIGS. 3 through 5, arm attachments 301, 303 may be removably attached to ports 113, 115, respectively, and rotating hook and latch systems 121, 123, respectively. The arm attachments 301, 303 include handlebars 305, 307, respectively, that horizontally extend away from the medial plane of the attachment 101. In some embodiments, the arm attachments 301, 303 may include a connecting bar 309 joined therebetween as shown in FIG. 3, however, alternatively the space between the arm attachments 301, 303 may be free from obstruction as shown in FIGS. 4 and 5.

A weight attachment 311 may be detachably connected to the free end of the arm 107 opposite the hinge connection 125. The weight attachment 311 enables incorporation of one or more weight plates 313 via a weight receiver 312. The weight attachment 311 may secure to the arm 107 via a sleeve 314 and one or more pins 316 as shown. In addition, a hook belt attachment 315 may be attached to the free end of the weight attachment 311 to enable the user to couple a hook belt thereto, thereby allowing the user to perform belt squat exercises on the attachment 101. As shown, the hook belt attachment 315 can include a plurality of hooks 320 on an angled plate 318, thereby allowing for user adjustability.

It should also be appreciated that one of the unique features believed characteristic of the present application is the rotating hook and latch systems 121, 123 that allow various attachments (e.g., handle attachments 117, 119 and arm attachments 301, 303) to serve as a balancing system to allow the user to articulate and maneuver their body in different ways to target different muscles as they would on a conventional belt squat machine or pendulum squat machine.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A belt and pendulum squat attachment for an exercise rig, the belt and pendulum squat attachment comprising:

a plate configured to secure to a vertical post;

an arm extending from a first end to a second end, the first end coupled to the plate via a hinge connection;

a first stationary side arm and a second stationary side arm each extending from the plate such that the arm is positioned substantially between the first stationary side arm and the second stationary side arm; and a rotating hook and latch system coupled to the first stationary side arm and the second stationary side arm, the rotating hook and latch system supporting the arm;

wherein the arm is configured to pivot about the hinge connection via operation by a user.

2. The belt and pendulum squat attachment of claim 1, wherein the rotating hook and latch system further comprises:

a first hook coupled to the first stationary side arm;

a second hook coupled to the second stationary side arm; and a connection bar extending between the first hook and the second hook;

wherein the connection bar supports the arm.

3. The belt and pendulum squat attachment of claim 1, further comprising:

a first port extending from the first stationary side arm; and a second port extending from the second stationary side arm.

4. The belt and pendulum squat attachment of claim 3, further comprising:

a first arm attachment releasably secured to the first port and extending upward and away from the arm; and a second arm attachment releasably secured to the second port and extending upward and away from the arm;

wherein the first arm attachment and the second arm attachment are configured to be operated by the user.

5. The belt and pendulum squat attachment of claim 3, further comprising:

a first handle releasably secured to the first port and extending upward and away from the arm; and a second handle releasably secured to the second port and extending upward and away from the arm;

wherein the first handle and the second handle are configured to be operated by the user.

6. The belt and pendulum squat attachment of claim 1, further comprising:

a shoulder pad attachment releasably attached to the second end of the arm, the shoulder pad attachment having:

a sleeve for engaging with the second end of the arm;

one or more handles extending from the sleeve; and a pad system coupled to the sleeve;

wherein the pad system is configured to be operated by the user.

7. The belt and pendulum squat attachment of claim 1, further comprising:

a weight attachment releasably attached to the second end of the arm, the weight attachment having:

a sleeve for engaging with the second end of the arm; and a weight receiver extending from the sleeve.

8. The belt and pendulum squat attachment of claim 7, wherein the weight attachment further comprises:

a hook belt attachment having an angled plate coupled to the sleeve and extending therefrom and a plurality of hooks extending from the angled plate.

* * * * *